US009114620B2

(12) United States Patent
Matsumoto et al.

(10) Patent No.: US 9,114,620 B2
(45) Date of Patent: Aug. 25, 2015

(54) LIQUID EJECTING APPARATUS

(75) Inventors: Hitoshi Matsumoto, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/358,488

(22) Filed: Jan. 25, 2012

(65) Prior Publication Data

US 2012/0194608 A1 Aug. 2, 2012

(30) Foreign Application Priority Data

Jan. 31, 2011 (JP) ..... 2011-017640

(51) Int. Cl.
*B41J 2/165* (2006.01)
*B41J 2/175* (2006.01)

(52) U.S. Cl.
CPC ..... *B41J 2/17509* (2013.01); *B41J 2/16532* (2013.01); *B41J 2/17596* (2013.01)

(58) Field of Classification Search
None
See application file for complete search history.

(56) References Cited

U.S. PATENT DOCUMENTS

| | | | | |
|---|---|---|---|---|
| 2003/0146958 | A1 | 8/2003 | Aruga et al. | |
| 2005/0231563 | A1* | 10/2005 | Fujishiro et al. | 347/69 |
| 2007/0115333 | A1* | 5/2007 | Aruga et al. | 347/85 |

FOREIGN PATENT DOCUMENTS

| | | |
|---|---|---|
| JP | 05-261934 | 10/1993 |
| JP | 2005-193570 | 7/2005 |
| JP | 2007-015409 | 1/2007 |
| JP | 2008-119886 | 5/2008 |
| JP | 2010-223259 | 10/2010 |
| JP | 2010-241036 | 10/2010 |

* cited by examiner

*Primary Examiner* — Alejandro Valencia
(74) *Attorney, Agent, or Firm* — Workman Nydegger

(57) ABSTRACT

A liquid ejecting apparatus includes a pressure control unit provided in a liquid flow path so as to control pressure. The pressure control unit includes a liquid introduction unit, a liquid chamber having a diaphragm, a communication hole that allows communication between the liquid introduction unit and the liquid chamber, and a wall portion provided on the side of the liquid chamber, so as to switch between a first mode in which the wall portion forms a first flow path for the liquid flowing through the communication hole toward the liquid outlet without contacting the diaphragm in accordance with a pressure in the liquid chamber, and a second mode in which the wall portion forms a second flow path different from the first flow path, in contact with the diaphragm.

15 Claims, 6 Drawing Sheets

LIQUID EJECTING APPARATUS

BACKGROUND

1. Technical Field

The present invention relates to a liquid ejecting apparatus.

2. Related Art

For example, JP-A-2007-15409 and JP-A-5-261934 disclose an ink jet printer as an exemplary form of a liquid ejecting apparatus.

The ink jet printer according to JP-A-2007-15409 includes a mechanism that displaces a pressure receiver of a self-closing valve, serving to control ink supply pressure to a liquid ejecting head, by applying an external force with a cam to the pressure receiver, to thereby discharge bubbles from the pressure chamber of the self-closing valve.

In the printer according to JP-A-5-261934, ink is supplied to the ink chamber through a second ink tank, a first ink tank, and a reservoir. The second ink tank includes a mechanism that stirs the ink by driving a motor so as to rotate a propeller, and an ink pressure controller is provided between the first ink tank and the second ink tank.

In the foregoing printers, it is essential to constantly stabilize the ink ejecting condition and performance, in order to maintain high printing quality. Accordingly, a pressure control unit such as a pressure-regulating valve or a damper that stores the ink so as to control the pressure thereof is provided in the ink flow path connecting between the ink cartridge and the ink jet head. Such a pressure control unit inevitably delays the flow of the ink owing to its required function, which leads to a disadvantage in that, in the case where a pigment dispersion ink is employed, ingredients of the solvent are prone to deposit in the ink flow path.

Although the mechanism according to JP-A-2007-15409 that displaces the pressure receiver of the self-closing valve by applying an external force with the cam to the pressure receiver can be expected to stir up the deposited ingredients when discharging the bubbles, the mechanism requires a complicated structure.

Likewise, the mechanism according to JP-A-5-261934 that stirs the ink by driving the motor so as to rotate the propeller also requires a complicated structure. In addition, a space for stirring the ink in which at least the propeller can be placed is necessary in order to incorporate such a stirring mechanism, which leads to an increase in size of the printer.

SUMMARY

An advantage of some aspects of the invention is that a liquid ejecting apparatus is provided that can stir up ingredients of the liquid deposited in a pressure control unit without employing a complicated mechanism.

In an aspect, the invention provides a liquid ejecting apparatus including a pressure control unit provided in a liquid flow path connecting between a liquid reservoir and a liquid ejecting head, and configured to store the liquid and control a pressure thereof, wherein the pressure control unit includes: a liquid introduction unit having a liquid inlet communicating with the liquid reservoir; a liquid chamber including a liquid outlet communicating with the side of the liquid ejecting head and a diaphragm to be displaced in accordance with a pressure; a communication hole that allows communication between the liquid introduction unit and the liquid chamber; and a wall portion provided on the side of the liquid chamber, so as to switch between a first mode in which the wall portion forms a first flow path for the liquid flowing through the communication hole toward the liquid outlet without contacting the diaphragm in accordance with a pressure in the liquid chamber, and a second mode in which the wall portion forms a second flow path different from the first flow path, in contact with the diaphragm.

In the thus-configured liquid ejecting apparatus, the diaphragm is displaced in accordance with the pressure in the liquid chamber, such that the liquid flow is switched between the first flow path in the first mode in which the diaphragm and the wall portion are not in contact with each other, and the second flow path in the second mode in which the diaphragm and the wall portion are in contact with each other, the second flow path being different from the first flow path. Such a variation of the liquid flow allows deposited ingredients of the liquid to be stirred up.

The liquid ejecting apparatus may further include a suction unit that sucks the liquid from the liquid ejecting head, and the flow of the liquid may be switched to the second mode when the pressure reaches a predetermined level by a sucking operation of the suction unit.

With such a configuration, the liquid flow is switched to the second mode when a cleaning is performed in which the liquid is forcibly sucked from the liquid ejecting head, so that the liquid flow through the communication hole toward the liquid outlet is changed. Such an arrangement allows the liquid flow in the first mode to be maintained in a normal operation in which the ink is ejected from the liquid ejecting head, thereby preventing the pressure control function from being affected by the switching operation of the liquid flow.

In the foregoing liquid ejecting apparatus, the wall portion may be provided at least between the communication hole and the liquid outlet.

Such a configuration allows, upon switching the liquid flow from the first mode to the second mode, formation of a liquid flow that circumvents the wall portion located between the communication hole and the liquid outlet in the second flow path, unlike in the first flow path. Accordingly, the liquid flow can be formed not only in a linear direction between the communication hole and the liquid outlet but over a more extensive range, and therefore the deposited ingredients of the liquid can be efficiently stirred up.

Further, an entrance of the second flow path may be open toward a bottom portion of the liquid chamber.

Such a configuration allows the ingredients of the liquid deposited on the bottom portion of the liquid chamber to be efficiently stirred up in the second mode.

Further, the entrance of the second flow path may be open toward the communication hole.

Such a configuration allows the communication hole and the second flow path to substantially continuously communicate with each other in the second mode, thereby allowing the liquid flow to be clearly defined.

Still further, the second flow path may be formed between the communication hole and the liquid outlet so as to pass through the bottom portion and a top portion of the liquid chamber.

Such a configuration allows not only the ingredients of the liquid deposited on the bottom portion of the liquid chamber, but also bubbles residing in the top portion thereof to be discharged by virtue of the liquid flow in the second mode.

Still further, the wall portion may be provided along a second wall portion forming an outer shape of the liquid chamber.

Providing thus the wall portion along the second wall portion forming the outer shape of the liquid chamber in which the deposited ingredients and bubbles are prone to reside allows the liquid to flow through the second flow path between the wall portion and the second wall portion in the second mode, thereby improving the efficiency in stirring up the deposited ingredients of the liquid and discharging the bubbles.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
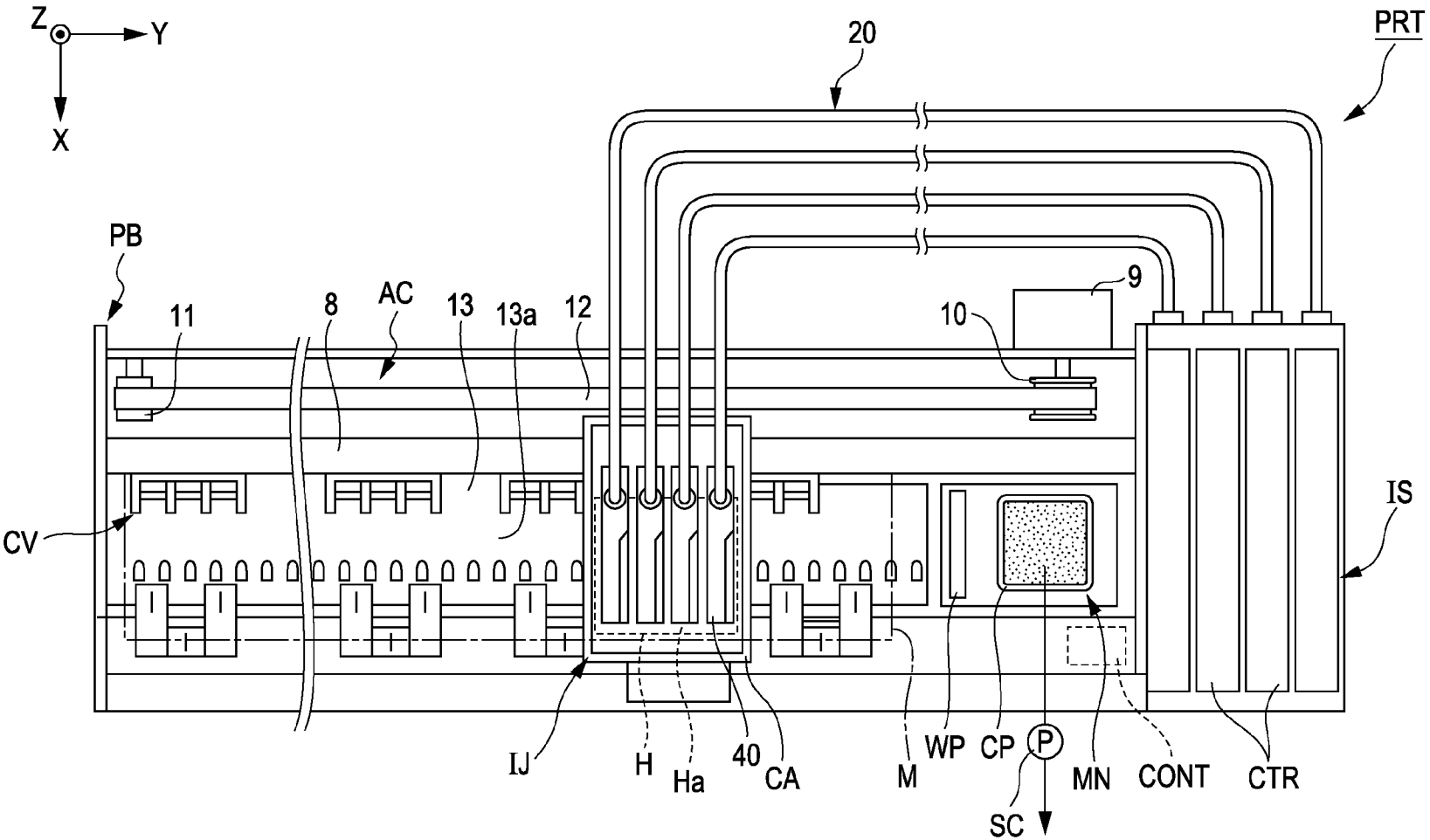
FIG. 1 is a schematic plan view of a printer according to an embodiment of the invention.

Hereafter, embodiments of a liquid ejecting apparatus according to the invention will be described referring to the drawings. In the drawings hereafter referred to, the scale of the constituents may be adjusted for the sake of clarity of the description. In the following embodiments, the liquid ejecting apparatus according to the invention will be exemplified by an ink jet printer, hereinafter simply referred to as a printer.

FIG. 1 is a schematic plan view of a printer PRT according to an embodiment of the invention.

The printer PRT shown in FIG. 1 is configured to perform printing while transporting a sheet-form recording medium M such as paper, a plastic sheet, or the like. The printer PRT includes a casing PB, an ink jet mechanism IJ that ejects an ink onto the recording medium M, an ink supply mechanism IS that supplies the ink to the ink jet mechanism IJ, a transport mechanism CV that transports the recording medium M, a maintenance mechanism MN that provides a maintenance operation for the ink jet mechanism IJ, and a control unit CONT that controls the foregoing constituents.

For the purpose of the description an XYZ orthogonal coordinate system is introduced, on the basis of which the positional relationship between the constituents will be described. In this embodiment, the direction in which the recording medium M is transported (hereinafter, transport direction) will be defined as X-axis direction; a direction orthogonal to the X-axis on a plane along which the recording medium M is transported will be defined as Y-axis direction; and a direction perpendicular to a plane that includes both the X-axis and the Y-axis will be defined as Z-axis.

The casing PB is formed such that a longer side thereof extends in the Y-axis direction. The casing PB accommodates therein the ink jet mechanism IJ, the ink supply mechanism IS, the transport mechanism CV, the maintenance mechanism MN and the control unit CONT. A platen 13 is provided in the casing PB. The platen 13 is a support member that supports the recording medium M. The platen 13 is located at a central position of the casing PB in the X-axis direction. The platen 13 includes a flat surface 13*a* oriented in the +Z direction. The flat surface 13*a* serves as a supporting surface that supports the recording medium M.

The transport mechanism CV includes a transport roller and a motor that drives the transport roller (neither shown). The transport mechanism CV transports the recording medium M from the −X side of the casing PB into inside thereof, and delivers the recording medium M to outside of the casing PB from the +X side thereof. The transport mechanism CV transports the recording medium M such that the recording medium M passes over the platen 13 inside the casing PB. The transport mechanism CV is controlled by the control unit CONT so as to adjust the timing and distance of the transportation.

The ink jet mechanism IJ includes an ink jet head (liquid ejecting head) H that ejects the ink, and a head moving mechanism AC that supports and moves the ink jet head H. The ink jet head H ejects the ink onto the recording medium M brought to the platen 13. The ink jet head H includes an ejection surface Ha from which the ink is ejected. The ejection surface Ha is oriented in the Z-axis direction, so as to oppose the supporting surface of the platen 13.

The head moving mechanism AC includes a carriage CA. The ink jet head H is fixed to the carriage CA. The carriage CA is set so as to move along a guide shaft 8 installed in the longitudinal direction of the casing PB, i.e., the Y-axis direction. The ink jet head H and the carriage CA are located on the +Z side of the platen 13.

In addition to the carriage CA, the head moving mechanism AC includes a pulse motor 9, a drive pulley 10 driven so as to rotate by the pulse motor 9, a slave pulley 11 provided on the −Y side opposite the drive pulley 10 (+Y side) in the longitudinal direction of the casing PB, and a timing belt 12 wound between the drive pulley 10 and the slave pulley 11.

The carriage CA is connected to the timing belt 12. The carriage CA is caused to move in the Y-axis direction by the rotation of the timing belt 12. The carriage CA is guided along the guide shaft 8, when moving in the Y-axis direction.

The maintenance mechanism MN is located at a home position of the ink jet head H. The home position is located in a region separated from the region where printing is performed on the recording medium M. In this embodiment, the home position is located on the +Y side of the platen 13. The home position is the position where the ink jet head H stands by when the power for the printer PRT is off and when printing has not been performed for a predetermined period of time.

The maintenance mechanism MN includes a capping mechanism CP that covers the ejection surface Ha of the ink jet head H and a wiping mechanism WP that wipes the ejection surface Ha. A suction unit SC, for example a suction pump, is connected to the capping mechanism CP. The capping mechanism CP is configured so as to suck the ink from the ink jet head H with the suction unit SC, while covering the ejection surface Ha.

The ink supply mechanism IS serves to supply the ink to the ink jet head H. The ink supply mechanism IS includes a plurality of ink cartridges (liquid reservoir) CTR. The printer PRT according to this embodiment, the ink cartridge CTR is not mounted on the carriage CA (off-carriage type), unlike the ink jet head H.

Figure 2:
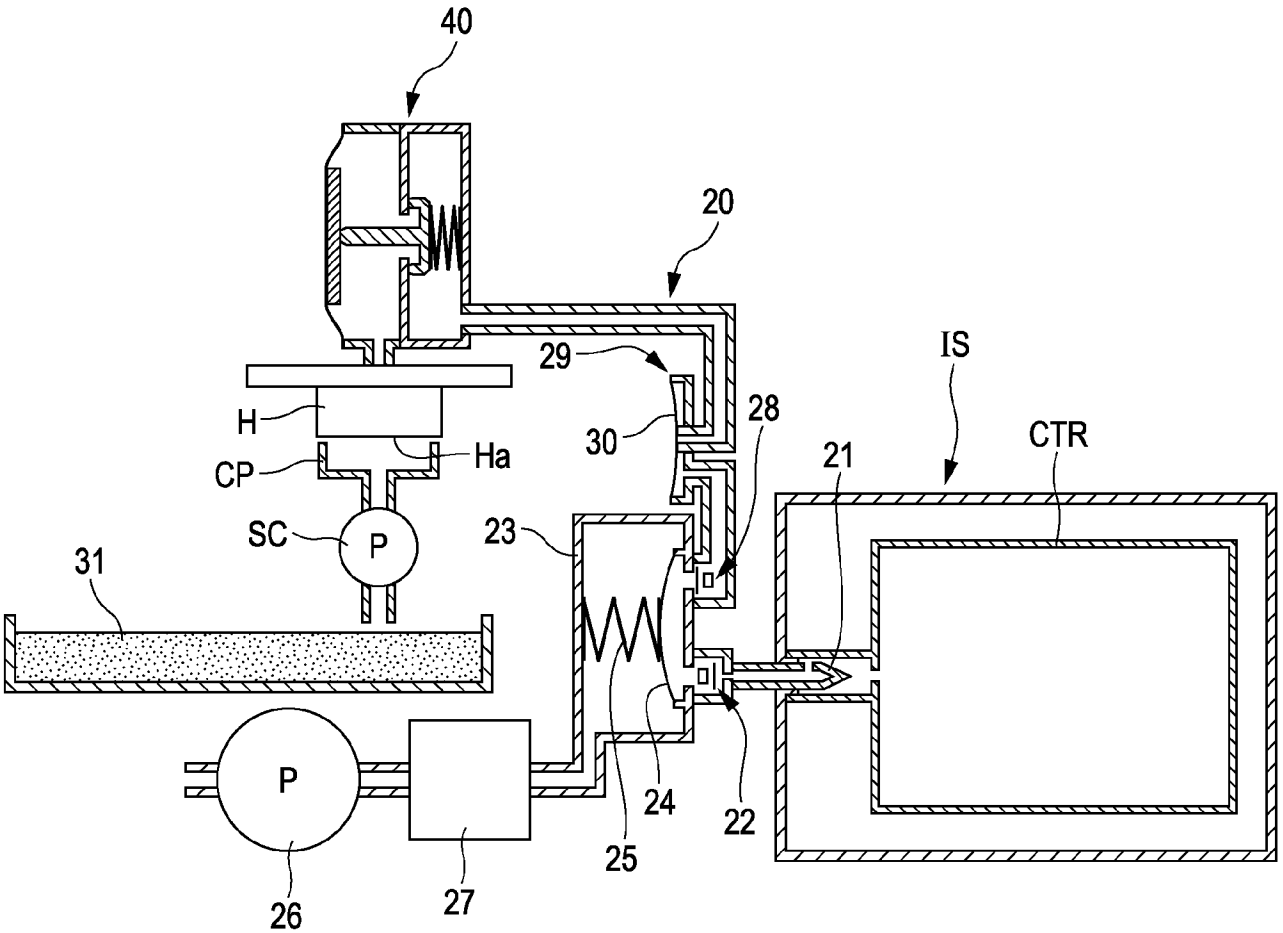
FIG. 2 is a schematic diagram showing a general configuration of an ink flow path of an ink supply mechanism according to the embodiment.

FIG. 2 is a schematic diagram showing a general configuration of an ink flow path 20 of the ink supply mechanism IS according to this embodiment.

The ink supply mechanism IS includes an ink flow path (liquid flow path) 20 connecting between the ink cartridge CTR and the ink jet head H. An ink supply needle 21 is provided at an end portion of the ink flow path 20. The ink supply needle 21 is inserted into the ink cartridge CTR, so as to allow communication between the inside of the ink cartridge CTR and the ink flow path 20.

The ink introduced into the ink flow path 20 through the ink supply needle 21 enters a depressurization chamber 23 trough a check valve 22. The depressurization chamber 23 includes a diaphragm 24 to be displaced in accordance with an internal pressure so as to change the capacity, and a compression spring 25 that biases the diaphragm 24. In addition, a depressurizing pump 26 that depressurizes the inside of the depressurization chamber 23, and an air-intake valve 27 that cancels the depressurization are connected to the depressurization chamber 23.

Upon activating the depressurizing pump 26 with the air-intake valve 27 closed, the diaphragm 24 expands against the biasing force of the compression spring 25, so that the ink can flow into the depressurization chamber 23 from the ink cartridge CTR. Upon stopping the depressurizing pump 26 and opening the air-intake valve 27, the diaphragm 24 is made to contract by the biasing force of the compression spring 25, so that the ink can flow out of the depressurization chamber 23 through the check valve 28, at a predetermined pressure.

The ink that has flowed out of the depressurization chamber 23 is supplied to the ink jet head H through a choke valve 29 and a self-closing valve (pressure control unit) 40. The choke valve 29 includes a diaphragm 30 that closes the ink flow path 20 when the suction unit SC of the capping mechanism CP depressurizes the side of the ink jet head H exceeding a predetermined pressure. The suction unit SC can perform so-called choke cleaning, utilizing the choke valve 29.

The choke cleaning is a process including driving the suction unit SC so as to depressurize the ink flow path 20 on the side of the ink jet head H, further depressurizing the closed flow path upstream of the choke valve 29 even after the choke valve 29 is closed, and introducing the pressurized ink to the choke valve 29 from the depressurization chamber 23 in the depressurized state, so as to allow the ink to flow with great force into the depressurized ink flow path 20 on the side of the ink jet head H upon opening the flow path thus far closed, to thereby forcibly discharge bubbles and thickened ink mixed in the self-closing valve 40 and the ink jet head H. The ink forcibly sucked and discharged from the ink jet head H is absorbed in an ink waste absorber 31.

Figure 3:
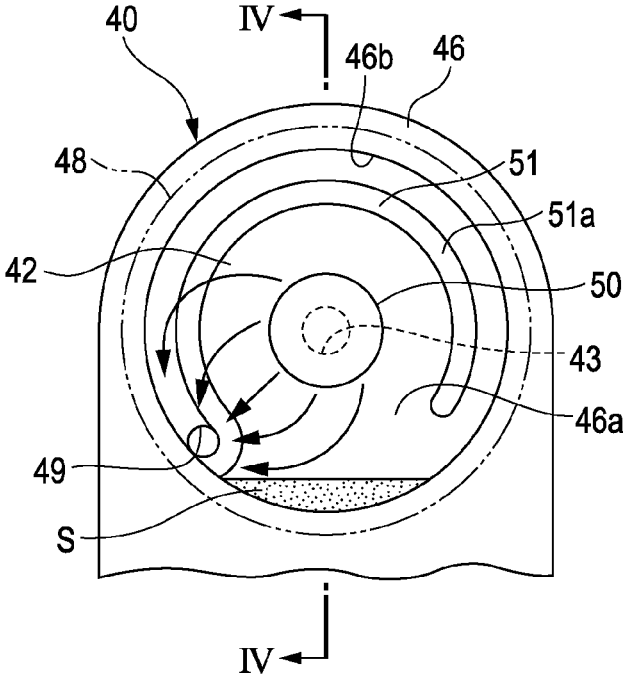
FIG. 3 is a schematic side view of a self-closing valve according to the embodiment.
Figure 4:
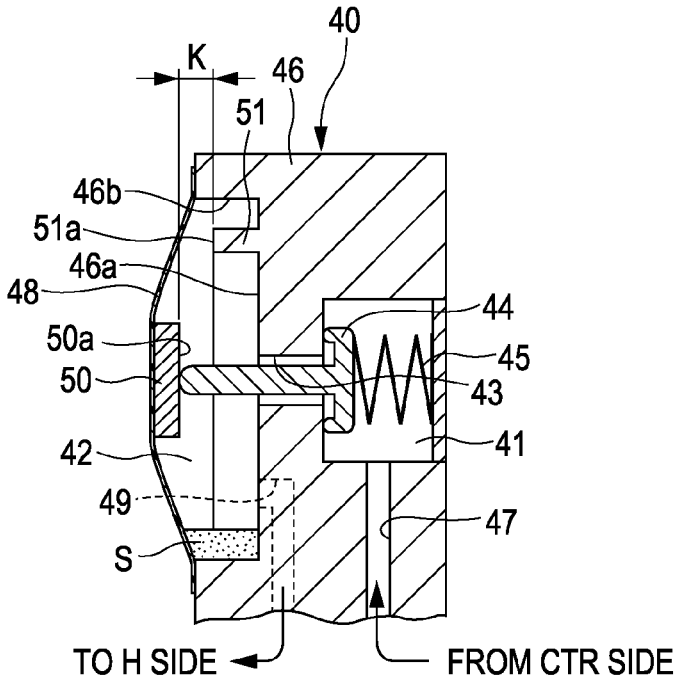
FIG. 4 is a cross-sectional view taken along a line IV-IV in FIG. 3.

FIG. 3 is a schematic side view of the self-closing valve 40 according to this embodiment. FIG. 4 is a cross-sectional view taken along a line IV-IV in FIG. 3. The up and down direction based on the orientation of FIGS. 3 and 4 corresponds to the vertical direction (direction of gravity), and a code S schematically represents deposited ingredients such as pigments contained in the ink.

The self-closing valve 40 is provided in the ink flow path 20 connecting between the ink cartridge CTR and the ink jet head H, and serves as a pressure-regulating valve so as to store the ink and open and close the ink flow path 20 in accordance with the pressure on the side of the ink jet head H. The self-closing valve 40 is mounted on the carriage CA together with the ink jet head H (see FIG. 1).

The self-closing valve 40 includes, as shown in FIG. 4, an on-off valve 44 that opens and closes a communication hole 43 that allows communication between a first ink chamber (liquid introduction unit) 41 located on the side of the ink cartridge CTR and a second ink chamber (liquid chamber) 42 located on the side of the ink jet head H. The on-off valve 44 can be displaced between a position for closing the communication hole 43 and a position for opening the communication hole 43 against a biasing force of a switching pressure control spring 45, in accordance with a pressure in the second ink chamber 42.

The on-off valve 44 according to this embodiment is configured to open the communication hole 43 with the on-off pressure control spring 45, in the case where the pressure in the second ink chamber 42 reaches −100 Pa from the atmospheric pressure. Assuming that the overall displacement stroke of the on-off valve 44 is 1 mm to 2 mm for example, the on-off valve 44 is configured to be displaced over a stroke of 0.03 mm to 0.05 mm in the above-mentioned case. Here, the on-off valve 44 is configured to be displaced over a range larger than 0.03 mm to 0.05 mm, for example over the entire stroke of 1 mm to 2 mm, when the suction unit SC sucks the ink at −80 kPa from the atmospheric pressure to perform the cleaning operation.

The first ink chamber 41 is defined by a base member 46, and includes an ink inlet (liquid inlet) 47 communicating with the side of the ink cartridge CTR. The ink inlet 47 is connected to the choke valve 29 via the ink flow path 20. The first ink chamber 41 has a predetermined capacity so as to store the ink introduced through the ink inlet 47. Also, an end portion of the on-off valve 44 capable of closing the communication hole 43 and the on-off pressure control spring 45 are accommodated inside the first ink chamber 41.

The second ink chamber 42 is defined by the base member 46 and a diaphragm 48, and includes an ink outlet (liquid outlet) 49 communicating with the side of the ink jet head H. The ink outlet 49 is connected to the ink jet head H via the ink flow path 20. The second ink chamber 42 has a variable capacity so as to store the ink introduced through the communication hole 43. Also, the other end portion of the on-off valve 44 and a pressure-receiving plate 50 are accommodated inside the second ink chamber 42.

The diaphragm 48 is composed of a multilayered flexible resin film. The diaphragm 48 is attached to a lateral face of the base member 46 with a predetermined play. The diaphragm 48 is displaced in accordance with the pressure in the second ink chamber 42, so as to change the volume of the second ink chamber 42.

The pressure-receiving plate 50 is hot-melt bonded to a resin layer such as a polypropylene layer to the surface of the diaphragm 48 oriented to the second ink chamber 42, so as to be displaced together with the diaphragm 48 in an interlocked manner. The pressure-receiving plate 50 includes an opposing surface 50*a* oriented to the communication hole 43. The other end portion of the on-off valve 44 inserted through the communication hole 43 is disposed in contact with the opposing surface 50*a*.

The pressure-receiving plate 50 is of a circular disk shape (see FIG. 3), and the other end portion of the on-off valve 44 is in contact with the central position of the circular opposing surface 50*a*. The on-off pressure control spring 45 is exerting its biasing force on the pressure-receiving plate 50 in a direction to expand the diaphragm 48. When the ink is consumed by the ink jet head H and the pressure in the second ink chamber 42 decreases so as to contract the diaphragm 48, the pressure-receiving plate 50 pushes back the on-off valve 44 against the biasing force of the on-off pressure control spring 45, so as to open the communication hole 43.

The second ink chamber 42 includes a partition wall (wall portion) 51. The partition wall 51 is erected on the surface 46*a* of the base member 46 where the communication hole 43 is formed, in a predetermined height toward the diaphragm 48. The partition wall 51 is formed along an outer wall (second wall portion) 46*b* of the base member 46 forming the outer shape of the second ink chamber 42, and extends to a position between the communication hole 43 and the ink outlet 49 (see FIG. 3). More specifically, the partition wall 51 extends along the outer wall 46*b* approximately half a circumference thereof through a top portion of the second ink chamber 42 from a position on a side of a horizontal line passing through the communication hole 43, so as to be connected to the outer wall 46*b* at a position on the opposite side of the horizontal line across the communication hole 43.

The top portion 51*a* of the partition wall 51 is, as shown in FIG. 4, spaced from the diaphragm 48 (more strictly, opposing surface 50*a* of the pressure-receiving plate 50) by a clearance K, except for while the cleaning is performed to forcibly suck the ink from the ink jet head H, in other words during a normal operation of ejecting the ink from the ink jet head H onto the recording medium M to thereby perform printing. More specifically, the clearance K is larger than the displacement stroke (0.03 mm to 0.05 mm) realized by the on-off valve 44 when the pressure in the second ink chamber 42 drops to −100 Pa or lower from the atmospheric pressure.

The partition wall 51 forms a first flow path for the ink flowing through the communication hole 43 to the ink outlet 49 except for during the cleaning operation, without contacting the diaphragm 48 as shown in FIG. 4 (first mode). Such a configuration allows the flow of the ink to be stably maintained as indicated by arrows in FIG. 3 during the normal operation of ejecting the ink from the ink jet head H, thereby preventing the pressure control function from being affected, for example, by fluctuation of the on-off pressure.

In the first mode, the first flow path is formed with the partition wall 51 and the diaphragm 48 spaced from each other, and therefore the ink introduced into the second ink chamber 42 through the communication hole 43 flows over the partition wall 51 so as to directly reach the ink outlet 49. The ink outlet 49 is located at an upper position from the bottom portion of the second ink chamber 42. Such a configuration prevents the deposited ingredients S on the bottom portion of the second ink chamber 42 from being supplied to the side of the ink jet head H through the ink outlet 49, during the normal operation of ejecting the ink from the ink jet head H.

Figure 5:
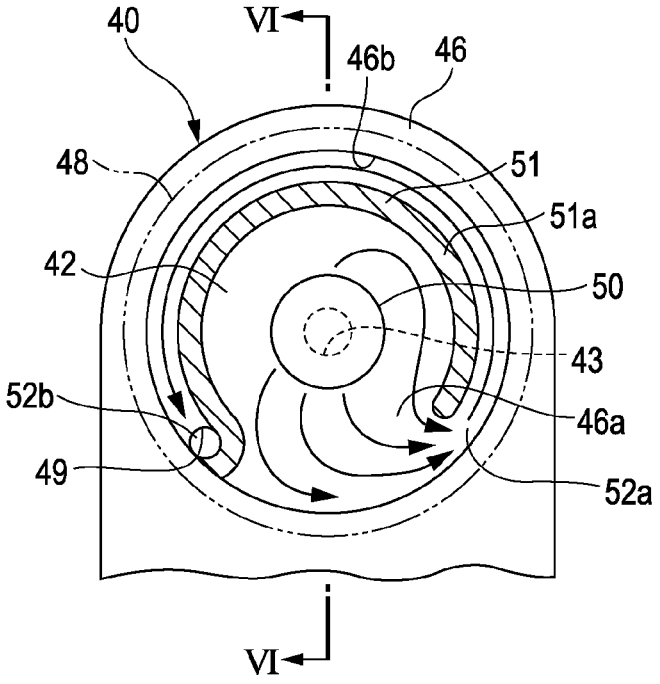
FIG. 5 is a schematic side view of the self-closing valve according to the embodiment, performing a cleaning operation.
Figure 6:
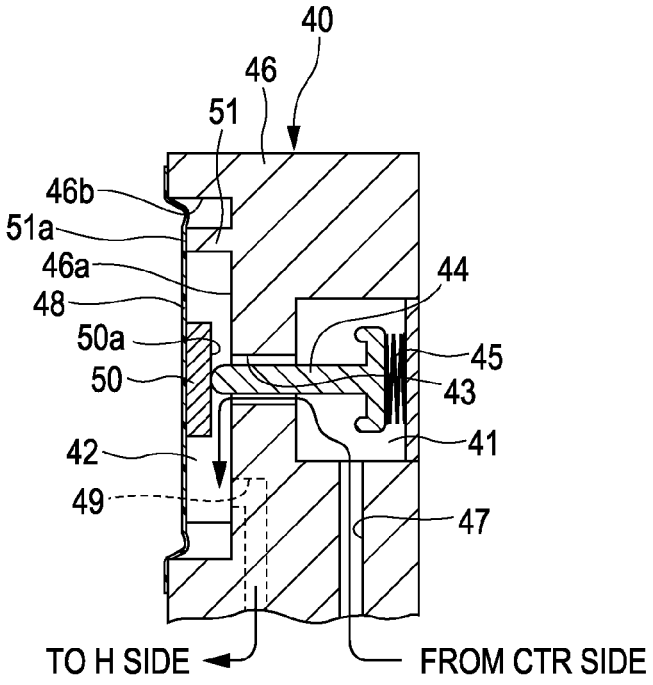
FIG. 6 is a cross-sectional view taken along a line VI-VI in FIG. 5.

FIG. 5 is a schematic side view of the self-closing valve 40 according to this embodiment, showing a state during the cleaning operation. FIG. 6 is a cross-sectional view taken along a line VI-VI in FIG. 5. Hatched portions in FIG. 5, as well as in FIGS. 7 to 10, represent the contact region between the partition wall 51 and the diaphragm 48.

The diaphragm 48 is brought into contact with the partition wall 51 so as to form a second flow path for the ink flowing through the communication hole 43 to the ink outlet 49 as shown in FIG. 5, when a predetermined pressure is reached because of the suction force of the suction unit SC for the cleaning operation (second mode). Here, the predetermined pressure is set in a range from −100 Pa or lower to −80 kPa or higher, from the atmospheric pressure.

The partition wall 51 is, as shown in FIG. 6, erected on the surface 46*a* of the base member 46 where the communication hole 43 is formed, in a predetermined height toward the diaphragm 48. Accordingly, when the diaphragm 48 is displaced so as to contact the top portion 51*a* of the partition wall 51, the ink is restricted from flowing over the top portion 51*a* of the partition wall 51, so that the second flow path which is different from the first flow path is formed. In other words, the partition wall 51 contacts with the diaphragm 48 which has contracted owing to the pressure during the cleaning operation to thereby close a part of the first flow path, as well as collaborates with the diaphragm 48 so as to form the second flow path that defines a flow channel different from the first flow path. Consequently, the flow of the ink is switched and a stirring flow is generated, by which the ingredients S deposited on the bottom portion can be stirred up.

As shown in FIG. 5, at least a part of the partition wall 51 is located between the communication hole 43 and the ink outlet 49. Upon switching from the first mode to the second mode, the ink is restricted from flowing over the partition wall 51 in the second flow path unlike in the first flow path (see FIG. 3), and the ink flows so as to circumvent the partition wall 51 provided between the communication hole 43 and the ink outlet 49 (see FIG. 5). Thus, the flow of the ink can be formed not only in a linear direction between the communication hole 43 and the ink outlet 49 but over a more extensive range, and therefore the deposited ingredients S of the ink can be efficiently stirred up.

The partition wall 51 is disposed along the outer wall 46*b* forming the outer shape of the second ink chamber 42. The partition wall 51 according to this embodiment extends along the outer wall 46*b* approximately half a circumference thereof through a top portion of the second ink chamber 42. Accordingly, in the case where bubbles are present in the top portion of the second ink chamber 42, the bubbles are facilitated to be discharged to outside through the ink outlet 49, by virtue of the ink flow through the second flow path. In addition, the entrance 52*a* of the second flow path is surrounded by the partition wall 51, the diaphragm 48, the surface 46*a* where the communication hole is formed, and the outer wall 46*b* and hence the cross-sectional area of the flow path is reduced. Accordingly, the flow speed increases upon entering the second flow path compared with the speed in the upstream region, and thus the ink flows with great force through the second flow path. Since the second flow path is curved along the outer wall 46*b*, the ink flow is subjected to a centrifugal force which allows the bubbles to be more efficiently discharged to outside.

The deposited ingredients S thus stirred up pass through the entrance 52*a* of the second flow path, and reach the exit 52*b* of the second flow path. At the exit 52*b*, the partition wall 51 is connected to the outer wall 46*b* and the ink outlet 49 is located at the foot of the connection point, and hence the deposited ingredients S stirred up flow out through the ink outlet 49, to be absorbed by the waste absorber 31 after passing through the ink jet head H and the suction unit SC. Stirring up the deposited ingredients S as above allows the deposited ingredients S to be efficiently removed, without the need to waste the entire ink in the second ink chamber 42 as in the conventional cleaning operation. This leads to reduced amount of the ink waste from the cleaning operation.

Thus, the printer PRT according to this embodiment includes the self-closing valve 40 provided in the ink flow path 20 connecting between the ink cartridge CTR and the ink jet head H, and configured to store the ink and to open and close the ink flow path 20 to thereby control the pressure thereof, and the self-closing valve 40 includes the first ink chamber 41 including the ink inlet 47 communicating with the side of the ink cartridge CTR, and the second ink chamber 42 including the ink outlet 49 communicating with the side of the ink jet head H and the diaphragm 48 to be displaced in accordance with the pressure so as to change the volume of the second ink chamber 42, the communication hole 43 that allows communication between the first ink chamber 41 and the second ink chamber 42, and the partition wall 51 provided on the side of the second ink chamber 42 so as to switch between the first mode in which the partition wall 51 forms the first flow path for the ink flowing through the communication hole 43 toward the ink outlet 49 without contacting the diaphragm 48 in accordance with the pressure in the second ink chamber 42, and the second mode in which the partition wall 51 forms the second flow path different from the first flow path, in contact with the diaphragm 48. Therefore, the diaphragm 48 is displaced in accordance with the pressure in the second ink chamber 42, such that the ink flow is switched between the first flow path in the first mode in which the diaphragm 48 and the partition wall 51 are not in contact with each other, and the second flow path in the second mode in which the diaphragm 48 and the partition wall 51 are in contact with each other. Such a variation of the ink flow allows the deposited ingredients S of the ink to be stirred up.

Consequently, the printer PRT according to this embodiment allows the ingredients S of the ink deposited in the self-closing valve 40 to be efficiently stirred up without employing a complicated mechanism.

Although the exemplary embodiment of the invention has been described as above, it is to be understood that the invention is in no way limited to the foregoing embodiment. The aforementioned shapes and combinations of the constituents are only exemplary, and may be modified in various manners within the scope of the invention, in accordance with designing requirements and so forth.

Figure 7:
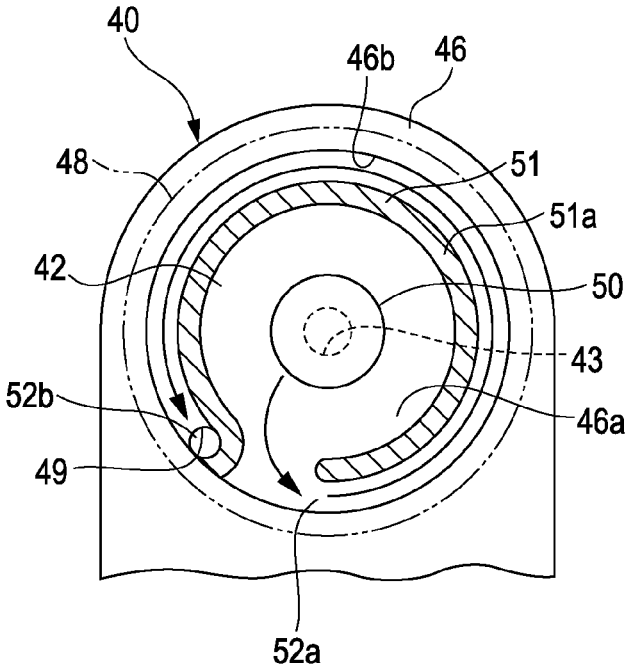
FIG. 7 is a schematic side view showing a configuration of a partition wall of the self-closing valve according to another embodiment of the invention.

For example, as shown in FIG. 7, the entrance 52*a* of the second flow path may be open toward the bottom portion of the second ink chamber 42. Such a configuration increases the flow speed of the ink along the bottom portion of the second ink chamber 42, thereby allowing the deposited ingredients S to be efficiently stirred up in the second mode. Further, the second flow path shown in FIG. 7 is formed between the communication hole 43 and the ink outlet 49 so as to pass through the bottom portion and the top portion of the second ink chamber 42. Such a configuration allows not only the ingredients S of the ink deposited on the bottom portion of the second ink chamber 42, but also bubbles residing in the top portion thereof to be discharged by virtue of the ink flow in the second mode.

Figure 8:
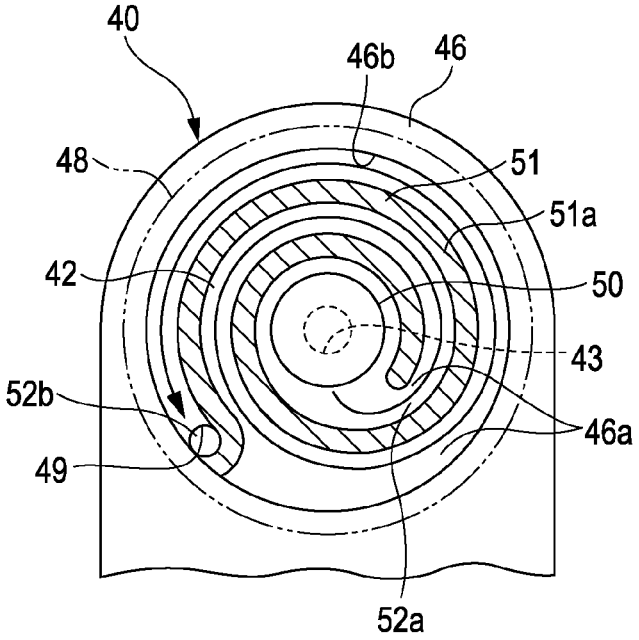
FIG. 8 is a schematic side view showing a configuration of a partition wall of the self-closing valve according to still another embodiment of the invention.

Alternatively, as shown in FIG. 8, the entrance 52*a* of the second flow path may be open toward the communication hole 43. Such a configuration allows the communication hole 43 and the second flow path to substantially continuously communicate with each other in the second mode, thereby allowing the liquid flow to be clearly defined. Further, the second flow path shown in FIG. 8 is formed in a helical shape in which the distance between the second flow path and the center of the communication hole 43 becomes longer toward the downstream side. Therefore, the ink flow is more efficiently subjected to the centrifugal force, and the deposited ingredients S and bubbles can be efficiently discharged to outside.

Figure 9:
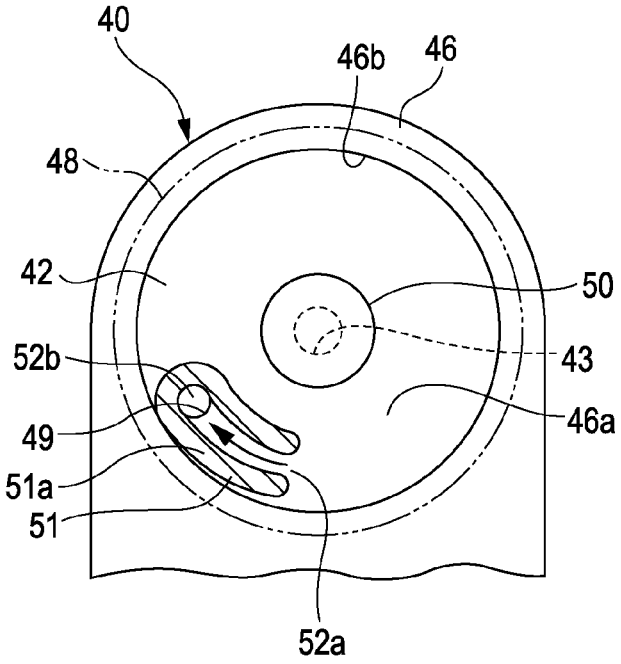
FIG. 9 is a schematic side view showing a configuration of a partition wall of the self-closing valve according to still another embodiment of the invention.

Although the partition wall 51 is provided along the outer wall 46*b* forming the outer shape of the second ink chamber 42 in the foregoing embodiment, the invention is not limited to such a configuration. For example, forming the partition wall 51 generally in a C-shape as shown in FIG. 9 also provides the same advantageous effects as those obtained from the embodiment. However, forming the partition wall 51 along the outer wall 46*b* forming the outer shape of the second ink chamber 42 as in the foregoing embodiment allows the outer wall 46*b* to be utilized as a part of the member that forms the second flow path, thereby contributing to reducing the footprint, the number of parts, and the manufacturing cost.

Figure 10:
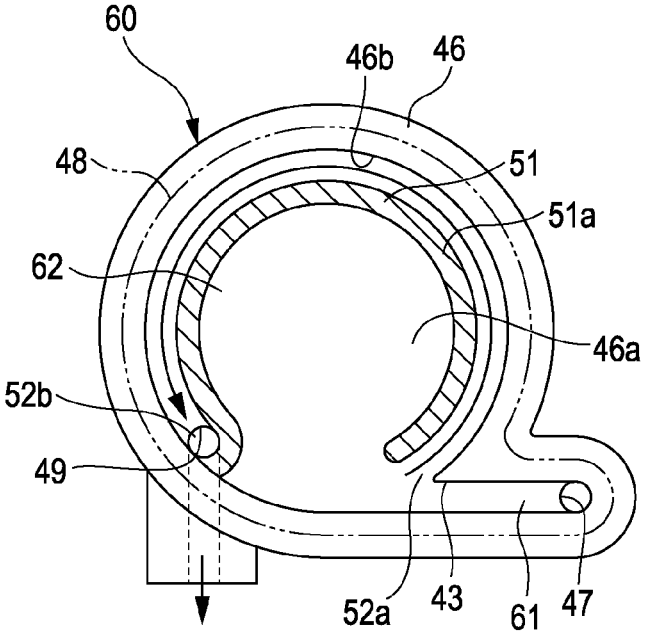
FIG. 10 is a schematic side view showing a damper according to still another embodiment of the invention.

Further, although the pressure control unit is exemplified by the self-closing valve 40 in the embodiment, the invention may be applied to different devices. For example, as shown in FIG. 10, the invention may be applied to a damper that does not include the on-off valve 44 and the on-off pressure control spring 45. Here, the reference numeral 61 in FIG. 10 designates an ink introduction unit (liquid introduction unit) including the ink inlet 47 communicating with the side of the ink cartridge CTR. The numeral 62 designates an ink chamber (liquid chamber) including the ink outlet 49 communicating with the side of the ink jet head H and the diaphragm 48 to be displaced in accordance with the pressure to thereby change the volume. With such a configuration also, providing the partition wall 51 that can switch between the first mode in which the partition wall 51 forms the first flow path without contacting the diaphragm 48 in accordance with the pressure in the ink chamber 62 and the second mode in which the partition wall 51 forms the second flow path different from the first flow path in contact with the diaphragm 48 provides the same advantageous effects as those obtained from the foregoing embodiment.

Further, although the liquid ejecting apparatus is exemplified by the printer PRT in the foregoing embodiment, the invention may be applied to different apparatuses such as a copier and a facsimile machine.

Still further, the liquid ejecting apparatus may be configured to eject or dispense a liquid other than the ink. The invention may be applied to various liquid ejecting apparatuses having a liquid ejecting head that ejects or dispenses a minute amount of liquid droplet. Here, the term "liquid droplet" refers to the state of the liquid dispensed from the liquid ejecting apparatus, and examples of the liquid droplet include a droplet having a particle shape, a droplet having a teardrop shape, and a droplet having a trailing tail shape. The liquid herein referred to includes those materials that can be ejected by the liquid ejecting apparatus. For example, materials in a liquid phase may be employed such as a liquid having a high or low viscosity, a sol, a gel water, an inorganic solvent, an organic solvent, a solution, a liquid resin, a liquid metal (molten metal liquid), and also a solvent in which particles of a functional material composed of a solid substance, such as a pigment or metal particle, are dissolved, dispersed or mixed may be employed, in addition to the materials in the liquid phase. The liquid can be typically exemplified by the ink referred to in the foregoing embodiment, and a liquid crystal. Here, the ink includes a general water-based ink, oil-based ink, and a liquid composition such as a gel ink and a hot-melt ink.

What is claimed is:

1. A liquid ejecting apparatus comprising a pressure control unit provided in a liquid flow path connecting between a liquid reservoir and a liquid ejecting head, and configured to store the liquid and control a pressure thereof, wherein the pressure control unit includes:

a base having a surface and an outer wall;

a liquid introduction unit having a liquid inlet communicating with the liquid reservoir;

a liquid chamber including a liquid outlet communicating with the liquid ejecting head and a diaphragm to be displaced in accordance with a pressure, wherein the liquid chamber is defined by the surface, the outer wall, and the diaphragm;

a communication hole that allows communication between the liquid introduction unit and the liquid chamber; and a wall portion provided on the surface of the base, so as to switch between a first mode in which the wall portion forms a first downward flow path for the liquid flowing through the communication hole toward the liquid outlet without contacting the diaphragm in accordance with a pressure in the liquid chamber, and a second mode in which the wall portion forms a second downward flow path different from the first downward flow path when in contact with the diaphragm, the wall portion being provided at a position closer to the outer wall than the communication hole along the outer wall between a communication hole side of the wall portion as an entrance of the second downward flow path and a liquid outlet side of the wall portion as an exit of the second downward flow path, and the communication hole side as the entrance of the second downward flow path being provided away from the communication hole.

2. The liquid ejecting apparatus according to claim 1, further comprising a suction unit that sucks the liquid from the liquid ejecting head, wherein the flow of the liquid is switched to the second mode when the pressure reaches a predetermined level by a sucking operation of the suction unit.

3. The liquid ejecting apparatus according to claim 1, wherein the wall portion is provided at least between the communication hole and the liquid outlet.

4. The liquid ejecting apparatus according to claim 1, wherein the entrance of the second downward flow path is open toward a bottom portion of the liquid chamber in a direction of gravity.

5. The liquid ejecting apparatus according to claim 1, wherein an entrance of the second flow path is open toward the communication hole.

6. The liquid ejecting apparatus according to claim 1, wherein the second flow path is formed between the communication hole and the liquid outlet so as to pass through a bottom portion and a top portion of the liquid chamber.

7. The liquid ejecting apparatus according to claim 1, wherein the wall portion cooperates with the diaphragm so as to switch between:

the first mode in which the wall portion forms the first downward flow path, and the second mode in which the wall portion forms the second downward flow path when in contact with the diaphragm, wherein the wall portion is configured to generate a stirring flow in the liquid when the wall portion is in contact with the diaphragm such that the liquid follows a path around the outer wall of the liquid chamber.

8. The liquid ejecting apparatus according to claim 1, wherein the liquid outlet is located at a foot of the end of the wall portion.

9. The liquid ejecting apparatus according to claim 1, wherein a beginning of the wall portion is located lower than the communication hole and higher than the liquid outlet in a direction of gravity.

10. The liquid ejecting apparatus according to claim 1, wherein the wall portion is formed so as to extend through a top portion of the liquid chamber.

11. The liquid ejecting apparatus according to claim 1, wherein the liquid outlet is located at an upper position from a bottom portion of the liquid chamber in the direction of gravity.

12. The liquid ejecting apparatus according to claim 1, wherein an end of the wall portion connects with the outer wall of the liquid chamber and the wall portion extends along and adjacent to the outer wall by at least half a circumference of the outer wall.

13. The liquid ejecting apparatus according to claim 1, wherein an end of the wall portion connects with the outer wall of the liquid chamber and circumscribes at least a portion of the communication hole, and wherein the liquid outlet is located at an end of the second downward flow path where the end of the wall portion connects with the outer wall and circumscribes at least a portion of the liquid outlet.

14. The liquid ejecting apparatus according to claim 1, wherein the second downward flow path is formed by the wall portion, the diaphragm and the outer wall, and a cross-sectional area of the second downward flow path is set so that flow of the second downward flow path is to be faster than flow between the communication hole and the entrance of the second downward flow path in the second mode.

15. The liquid ejecting apparatus according to claim 1, further comprising a pressure-receiving member operable to displace together with the diaphragm, the pressure-receiving member including a surface oriented toward the communication hole, wherein the wall portion is located at a position not in contact with the opposing surface.

* * * * *